US011022382B2

(12) United States Patent
Cao et al.

(10) Patent No.: US 11,022,382 B2
(45) Date of Patent: Jun. 1, 2021

(54) SYSTEM AND METHOD FOR HEAT EXCHANGER OF AN HVAC AND R SYSTEM

(71) Applicant: Johnson Controls Technology Company, Auburn Hills, MI (US)

(72) Inventors: Kevin M. Cao, Oklahoma City, OK (US); Randal H. Edmunds, Norman, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 98 days.

(21) Appl. No.: 15/975,661

(22) Filed: May 9, 2018

(65) Prior Publication Data

US 2019/0277577 A1 Sep. 12, 2019

Related U.S. Application Data

(60) Provisional application No. 62/640,469, filed on Mar. 8, 2018.

(51) Int. Cl.

| | |
|---|---|
| ***F28F 1/12*** | (2006.01) |
| ***F28F 17/00*** | (2006.01) |
| ***F28F 1/00*** | (2006.01) |
| ***F25B 39/00*** | (2006.01) |
| ***F28D 21/00*** | (2006.01) |
| ***F25D 21/14*** | (2006.01) |
| ***F24F 13/22*** | (2006.01) |

(52) U.S. Cl.

CPC ..... *F28F 1/128* (2013.01); *F25B 39/00* (2013.01); *F28F 1/006* (2013.01); *F28F 17/005* (2013.01); *F24F 2013/227* (2013.01); *F25D 21/14* (2013.01); *F25D 2321/146* (2013.01); *F28D 2021/0024* (2013.01)

(58) Field of Classification Search

CPC ..... F28F 1/128; F28F 1/006; F28F 17/005; F25B 39/00; F24F 2013/227

See application file for complete search history.

(56) References Cited

U.S. PATENT DOCUMENTS

| | | | |
|---|---|---|---|
| 4,242,876 | A | 1/1981 | Cooper et al. |
| 4,281,972 | A | 8/1981 | Jacobs |
| 4,421,460 | A | 12/1983 | Jacobs |
| 5,167,491 | A | 12/1992 | Keller, Jr. et al. |
| 5,203,679 | A | 4/1993 | Yun et al. |
| 5,597,293 | A | 1/1997 | Bushnell et al. |
| 5,622,057 | A | 4/1997 | Bussjager et al. |

(Continued)

FOREIGN PATENT DOCUMENTS

WO WO2017030922 A1 2/2017

*Primary Examiner* — Jon T. Schermerhorn, Jr.
(74) *Attorney, Agent, or Firm* — Fletcher Yoder, P.C.

(57) ABSTRACT

The present disclosure relates to a heat exchanger for a heating, ventilating, and air conditioning (HVAC) system that includes a first slab having a first plurality of tubes extending between a first manifold and a second manifold and a second slab having a second plurality of tubes and a third plurality of tubes. The second plurality of tubes extends between a third manifold and a fourth manifold and the third plurality of tubes extends between the fourth manifold and a fifth manifold, such that the heat exchanger defines a refrigerant path sequentially through the first plurality of tubes, the second plurality of tubes, and the third plurality of tubes.

16 Claims, 11 Drawing Sheets

(56) References Cited

U.S. PATENT DOCUMENTS 5,848,537 A 12/1998 Biancardi et al.
6,021,775 A 2/2000 Dempsey et al.
6,067,812 A 5/2000 Bushnell et al.
6,070,420 A 6/2000 Biancardi et al.
6,349,555 B1 2/2002 Barros et al.
6,363,735 B1 4/2002 Bushnell et al.
6,382,310 B1 5/2002 Smith
6,470,878 B1 10/2002 Brown et al.
6,484,798 B1 11/2002 Manohar et al.
6,564,794 B1 5/2003 Zia et al.
6,732,789 B2 * 5/2004 Jang ..... F28D 1/05391 165/110
6,735,967 B1 5/2004 Bischel et al.
6,745,827 B2 * 6/2004 Lee ..... F25B 39/02 165/144
6,793,015 B1 9/2004 Brown et al.
6,955,057 B2 10/2005 Taras et al.
6,964,296 B2 * 11/2005 Memory ..... B21D 53/085 165/151
7,043,930 B2 5/2006 Bussjager
7,044,200 B2 5/2006 Gupte et al.
7,096,933 B1 8/2006 Zia et al.
7,377,126 B2 5/2008 Gorbounov et al.
7,503,183 B2 3/2009 Bussjager
7,571,622 B2 8/2009 Ballet et al.
8,113,008 B2 2/2012 Heinbokel et al.
8,116,911 B2 2/2012 Bailey et al.
8,117,860 B2 2/2012 Stone et al.
8,225,853 B2 7/2012 Macri et al.
8,230,694 B2 7/2012 Scarcella et al.
8,316,657 B2 11/2012 Lifson
8,484,990 B2 7/2013 Ballet et al.
8,627,670 B2 1/2014 Moraes et al.
8,683,817 B2 4/2014 Fraser
8,695,375 B2 4/2014 Kirkwood
8,844,303 B2 9/2014 Heinbokel et al.
8,887,518 B2 11/2014 Mercer et al.
9,016,082 B2 4/2015 Hancock
9,163,866 B2 10/2015 Buckley et al.
9,234,673 B2 1/2016 Douglas et al.
9,261,300 B2 2/2016 Golden et al.
9,395,125 B2 7/2016 Fox et al.
9,476,614 B2 10/2016 Heinbokel et al.
9,482,454 B2 11/2016 Goel et al.
9,494,345 B2 11/2016 Heinbokel et al.
9,546,807 B2 1/2017 Goel et al.
9,601,919 B2 3/2017 Helt
9,625,184 B2 4/2017 Hu et al.
9,739,519 B2 8/2017 Gan et al.
9,909,818 B2 3/2018 Goodman et al.
2004/0003916 A1 1/2004 Nash et al.
2005/0189090 A1 9/2005 Gupte
2008/0092573 A1 4/2008 Vaisman et al.
2008/0092587 A1 4/2008 Gorbounov et al.
2008/0093062 A1 4/2008 Gorbounov et al.
2008/0110606 A1 5/2008 Gorbounov et al.
2008/0110608 A1 5/2008 Gorbounov et al.
2008/0127667 A1 6/2008 Buckley et al.
2008/0251245 A1 10/2008 Gorbounov et al.
2008/0289806 A1 11/2008 Gorbounov et al.
2008/0296005 A1 12/2008 Taras et al.
2009/0113900 A1 5/2009 Lifson et al.
2010/0012305 A1 1/2010 Taras et al.
2010/0012307 A1 1/2010 Taras et al.
2010/0024452 A1 2/2010 Lifson et al.
2010/0037652 A1 2/2010 Gorbounov et al.
2010/0089095 A1 4/2010 Macri et al.
2010/0089559 A1 4/2010 Gorbounov et al.
2010/0094434 A1 4/2010 Ballet et al.
2010/0101248 A1 4/2010 Lifson
2010/0107659 A1 5/2010 Hildreth, Jr.
2010/0107675 A1 5/2010 Lifson et al.
2010/0125368 A1 5/2010 Bailey et al.
2010/0205984 A1 8/2010 Gu et al.
2010/0206535 A1 8/2010 Munoz et al.
2010/0236283 A1 9/2010 Ballet et al.
2010/0326100 A1 12/2010 Taras et al.
2011/0030934 A1 2/2011 Munoz et al.
2011/0056668 A1 3/2011 Taras et al.
2011/0132585 A1 6/2011 Chen et al.
2011/0139859 A1 6/2011 Jaworowski et al.
2011/0174014 A1 7/2011 Scarcella et al.
2011/0296856 A1 12/2011 Hancock
2012/0080179 A1 4/2012 Mercer et al.
2012/0118748 A1 5/2012 Jaworowski et al.
2012/0174605 A1 7/2012 Huff et al.
2012/0227945 A1 * 9/2012 Taras ..... F28D 1/05391 165/172
2013/0074534 A1 3/2013 Schneider et al.
2013/0091883 A1 4/2013 Perez et al.
2013/0092355 A1 4/2013 Douglas et al.
2013/0179373 A1 7/2013 Mutchnik et al.
2013/0240186 A1 * 9/2013 Taras ..... F28D 1/05391 165/146
2014/0131599 A1 5/2014 Golden et al.
2014/0140810 A1 5/2014 Balistreri et al.
2014/0262181 A1 * 9/2014 Taras ..... F28F 17/005 165/173
2015/0027677 A1 1/2015 Taras et al.
2015/0082818 A1 3/2015 Peitz et al.
2015/0260458 A1 9/2015 Goel et al.
2015/0267951 A1 9/2015 Berg et al.
2015/0300744 A1 10/2015 Goel et al.
2015/0330684 A1 11/2015 Goel et al.
2016/0033182 A1 2/2016 Joardar et al.
2017/0010032 A1 1/2017 Goel et al.
2017/0059219 A1 3/2017 Goel
2017/0153062 A1 6/2017 Joardar et al.
2017/0343288 A1 11/2017 Joardar
2018/0023895 A1 1/2018 Kraft et al.

* cited by examiner

SYSTEM AND METHOD FOR HEAT EXCHANGER OF AN HVAC AND R SYSTEM

CROSS REFERENCE TO RELATED APPLICATION

This application is a U.S. Non-Provisional application claiming priority from and the benefit of U.S. Provisional Application Ser. No. 62/640,469, entitled "SYSTEM AND METHOD FOR HEAT EXCHANGER OF AN HVAC&R SYSTEM," filed Mar. 8, 2018, which is hereby incorporated by reference in its entirety for all purposes.

BACKGROUND

This disclosure relates generally to heating, ventilating, and air conditioning (HVAC) systems. Specifically, the present disclosure relates to heat exchangers for HVAC units.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

A heating, ventilating, and air conditioning (HVAC) system may be used to thermally regulate an environment, such as a building, home, or other structure. The HVAC system may include a vapor compression system, which includes heat exchangers such as a condenser and an evaporator, which transfer thermal energy between the HVAC system and the environment. A refrigerant may be used as a heat transfer fluid that is directed through the heat exchangers of the vapor compression system. In some cases, the HVAC system may cool a flow of fluid by directing the fluid across a heat exchange area of an evaporator. For example, the refrigerant flowing through the evaporator may absorb thermal energy from the flow of fluid to be cooled, and thus decrease the thermal energy of the flow of fluid to be cooled. In many cases, the thermal energy absorbed by the refrigerant may heat the refrigerant to a hot, gaseous phase. The gaseous refrigerant may be directed through a condenser, which may remove the absorbed thermal energy the refrigerant and transfer the thermal energy to a cooling fluid.

Due to spatial constraints, typical condensers are unable to remove a sufficient amount of thermal energy from the refrigerant that enables the refrigerant to completely change phase within the condenser. In many cases, typical condensers may thus exhaust a two-phase mixture of refrigerant that is insufficiently cooled, which is subsequently recirculated through the HVAC system. The two-phase refrigerant may be unable to effectively absorb heat from the fluid to be cooled. Unfortunately, this may decrease the ability of the HVAC system to transfer thermal energy between the fluid to be cooled and the refrigerant, which decreases the efficiency of the HVAC system.

SUMMARY

The present disclosure relates to a heat exchanger for a heating, ventilating, and air conditioning (HVAC) system that includes a first slab having a first plurality of tubes extending between a first manifold and a second manifold and a second slab having a second plurality of tubes and a third plurality of tubes. The second plurality of tubes extends between a third manifold and a fourth manifold and the third plurality of tubes extends between the fourth manifold and a fifth manifold, such that the heat exchanger defines a refrigerant path sequentially through the first plurality of tubes, the second plurality of tubes, and the third plurality of tubes.

The present disclosure also relates to a heating, ventilating, and air conditioning (HVAC) heat exchanger including a first slab extending along a length of the HVAC heat exchanger having a first manifold and a second manifold and a first plurality of tubes extending between the first manifold and the second manifold to define a first pass of the HVAC heat exchanger. The HVAC heat exchanger also includes a second slab extending along the length of the HVAC heat exchanger having a third manifold and a fourth manifold. The third manifold is divided into an upper chamber and a lower chamber, such that a second plurality of tubes extends between the upper chamber and the fourth manifold to define a second pass of the HVAC heat exchanger and a third plurality of tubes extend between the lower chamber and the fourth manifold to define a third pass of the HVAC heat exchanger.

The present disclosure also relates to a method for operating a heat exchanger, including directing a refrigerant through a first plurality of tubes in a first direction, in which the first plurality of tubes is disposed within a first slab of the heat exchanger. The method also includes directing the refrigerant through a second plurality of tubes in a second direction, in which the second plurality of tubes is disposed within a second slab of the heat exchanger and the second direction is opposite of the first direction. The method further includes directing the refrigerant through a third plurality of tubes in the first direction, in which the third plurality of tubes is disposed within the second slab.

The present disclosure also relates to a heat exchanger including a first network of heat exchanger tubes having a first inlet manifold and a first outlet manifold, in which the first network of heat exchanger tubes includes a first length, a first height, and a first width. The heat exchanger also includes a second network of heat exchanger tubes having a second inlet manifold and a second outlet manifold, in which the second network of heat exchanger tubes includes second length, a second height, and a second width. The heat exchanger further includes a third network of heat exchanger tubes having a third inlet manifold and a third outlet manifold, in which the third network of heat exchanger tubes includes a third length, a third height, and a third width and the second network of heat exchanger tubes and the third network of heat exchanger tubes are stacked along their respective height dimensions. The first width of first network of heat exchanger tubes is adjacent the second width of the second network of heat exchanger tubes and the third width of the third network of heat exchanger tubes. The first outlet manifold of the first network of heat exchanger tubes is coupled to the second inlet manifold of the second network of heat exchanger tubes and the second outlet manifold of the second network of heat exchanger tubes is coupled to the third inlet manifold of the third network of heat exchanger tubes.

BRIEF DESCRIPTION OF THE DRAWINGS

Various aspects of this disclosure may be better understood upon reading the following detailed description and upon reference to the drawings in which.

DETAILED DESCRIPTION

Figure 1:
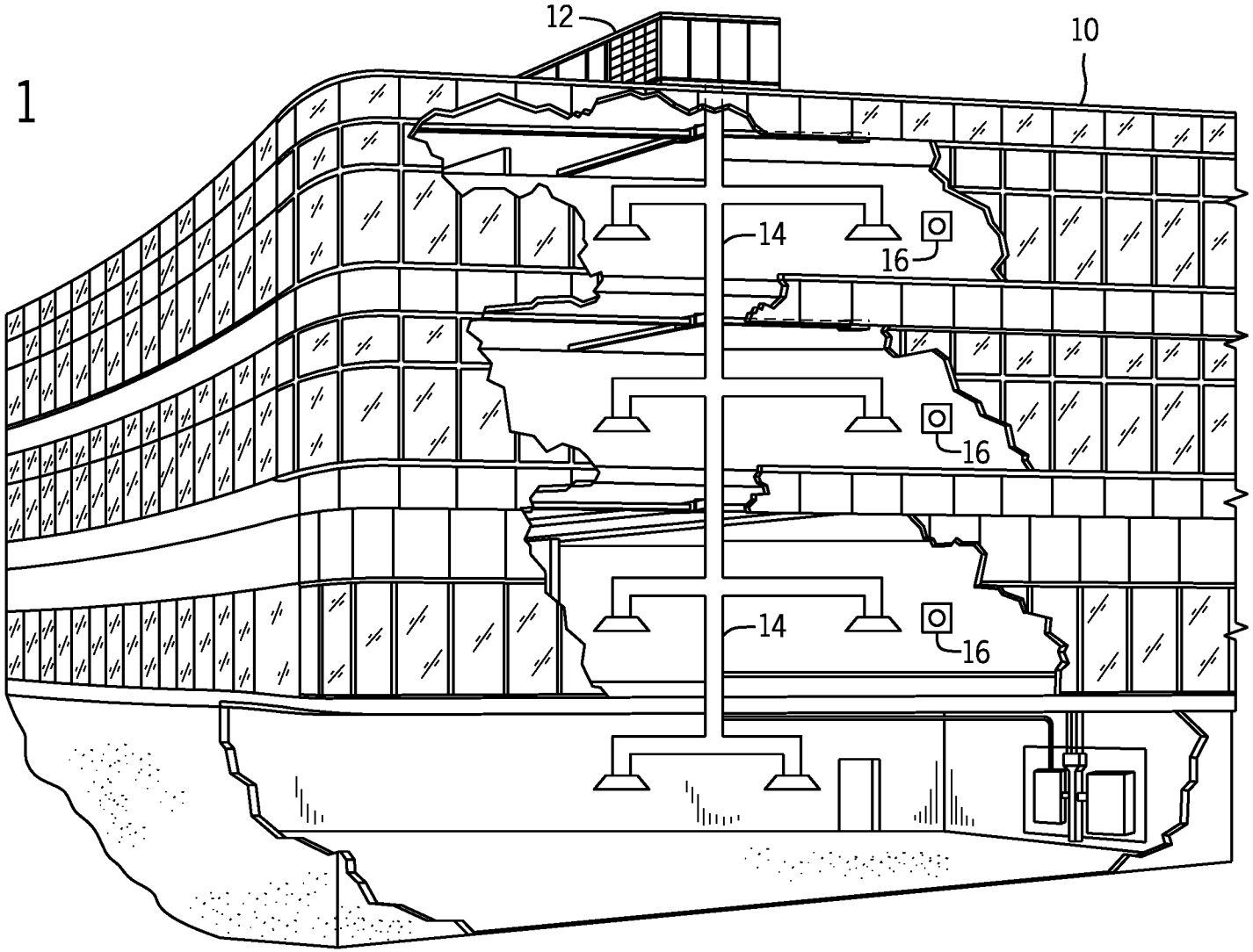
FIG. 1 is a perspective view of an embodiment of a building that may utilize a heating, ventilating, and air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

A vapor compression system includes heat exchangers, such as a condenser and an evaporator, that transfer thermal energy between a heat transfer fluid, such as a refrigerant and a fluid to be conditioned, such as air. A compressor is used to circulate the refrigerant through conduits of the vapor compression system, which fluidly couple the condenser, the evaporator, and the compressor. In some cases, the vapor compression system may be configured to cool a flow of air by directing the flow of air across the evaporator of the vapor compression system. A refrigerant flowing through the evaporator may absorb heat from the flow of air, and thus change phase within the evaporator. The refrigerant may exit the evaporator in a hot, gaseous state. In many cases, the condenser is used to remove the absorbed thermal energy from the refrigerant, such that the refrigerant may change phase before being recirculated through the conduits of the vapor compression system. Typical condensers may be unable to sufficiently condense the refrigerant, such that a two-phase mixture of liquid and gaseous refrigerant exits the condenser and is recirculated in the vapor compression system. Unfortunately, this may decrease the efficiently of the vapor compression system.

Embodiments of the present disclosure are directed to a heat exchanger, such as a condenser, that may increase the efficiency of thermal energy transfer between the refrigerant and a flow of air by enabling the refrigerant to complete multiple passes through the condenser. For example, the heat exchanger may include a plurality of tubes, such as micro-channel tubes, that enable the refrigerant to complete a predetermined amount of passes through the heat exchanger. In some embodiments, the heat exchanger may include a first slab and a second slab disposed adjacent to one another, which each include a plurality of micro-channel tubes. The refrigerant may complete a first pass through a first plurality of tubes disposed within the first slab. The refrigerant may complete a second and third pass through a second plurality of tubes and a third plurality of tubes, respectively, which are disposed within the second slab. In some cases, gaseous refrigerant from the vapor compression system may flow into the first slab of the heat exchanger and condense, or partially condense, within the first plurality of tubes. The refrigerant may enter the second slab and fully condense while completing the second pass through the second plurality of tubes. Finally, the refrigerant may be sub-cooled while completing the third pass through the third plurality of tubes. Accordingly, embodiments of the heat exchanger disclosed herein may efficiently remove thermal energy from the refrigerant, and thus improve an efficiency of the HVAC system.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
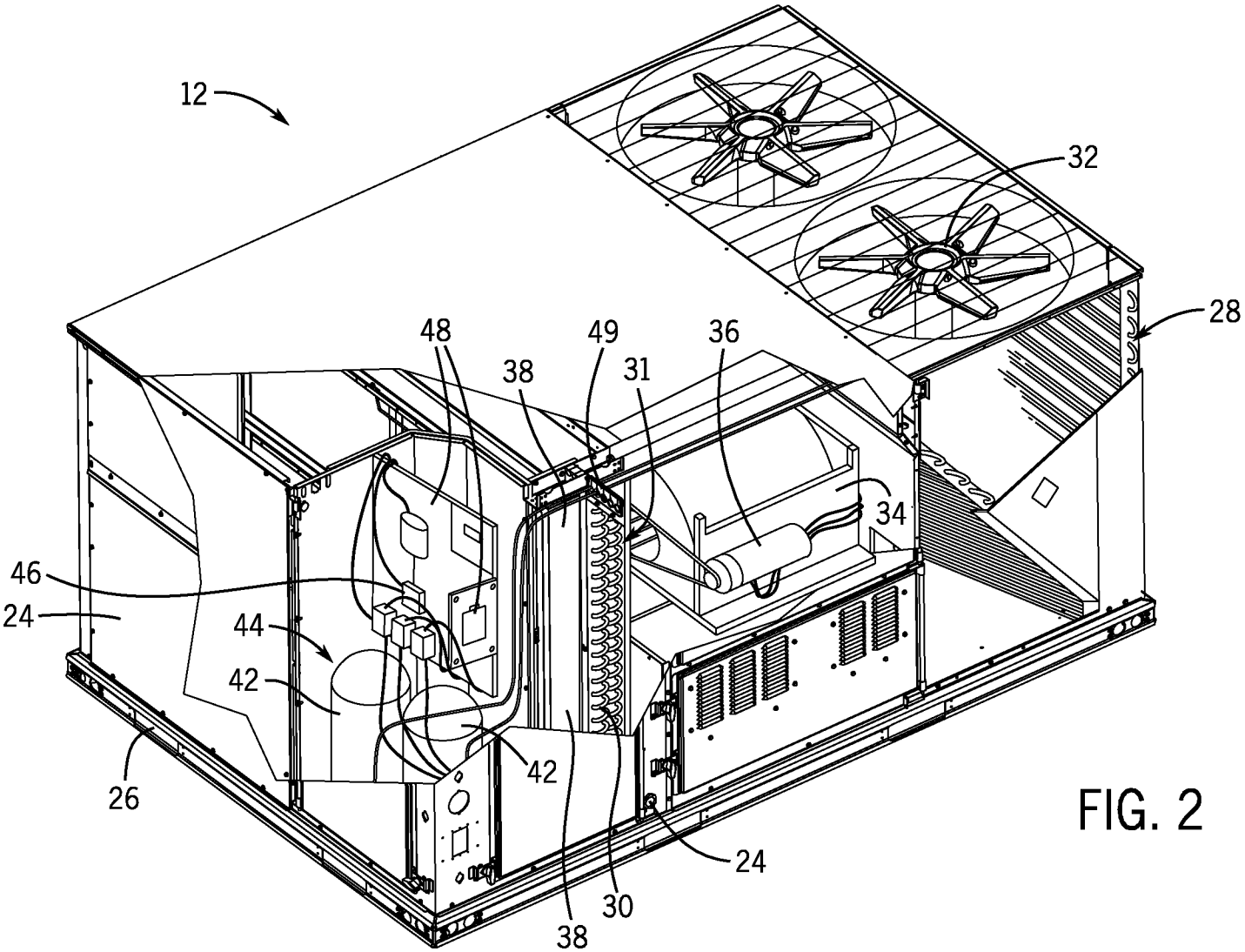
FIG. 2 is a perspective view of an embodiment of a vapor compression system, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
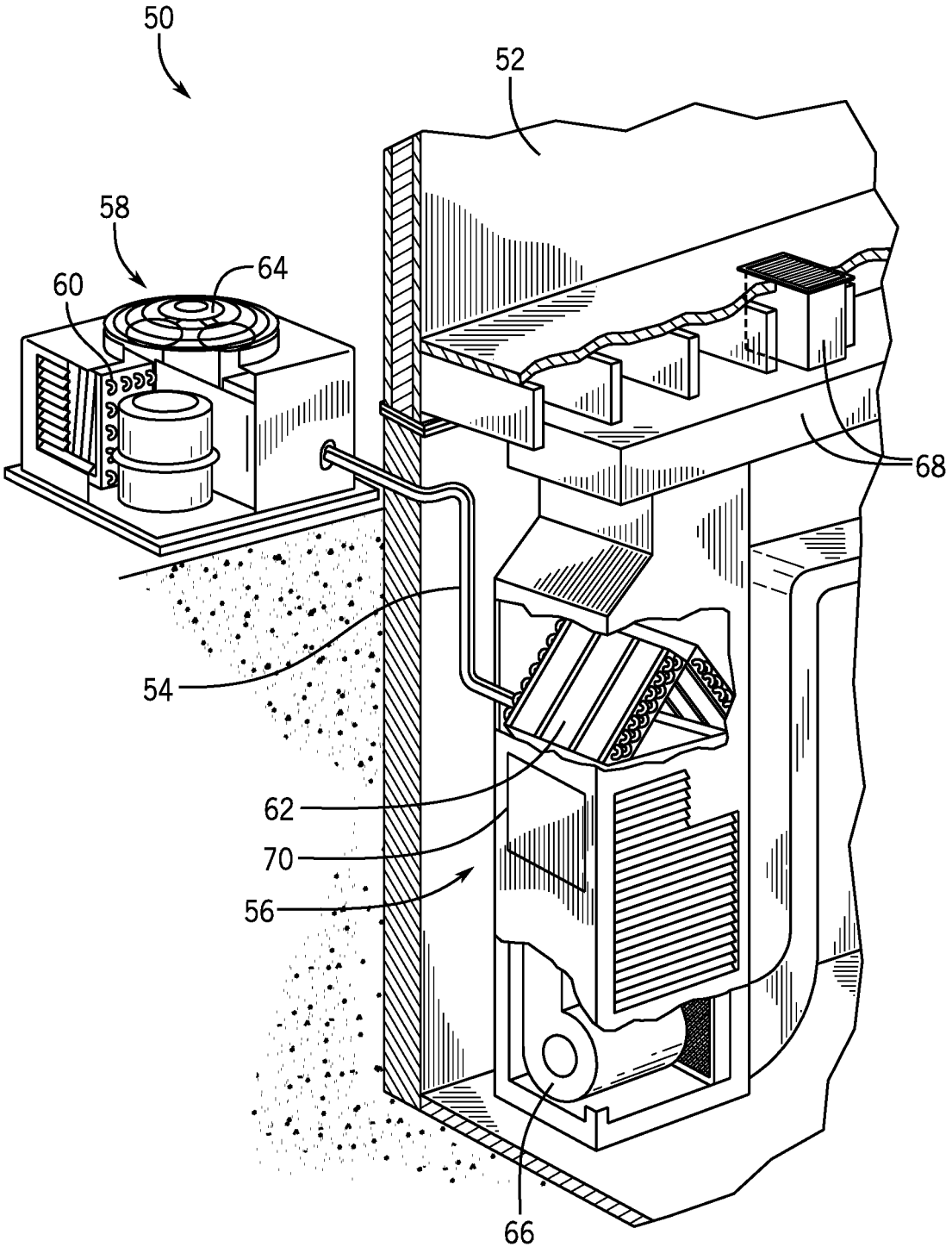
FIG. 3 is a schematic of an embodiment of the vapor compression system of FIG. 2, in accordance with an aspect of the present disclosure.

FIG. 3 illustrates a residential heating and cooling system, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
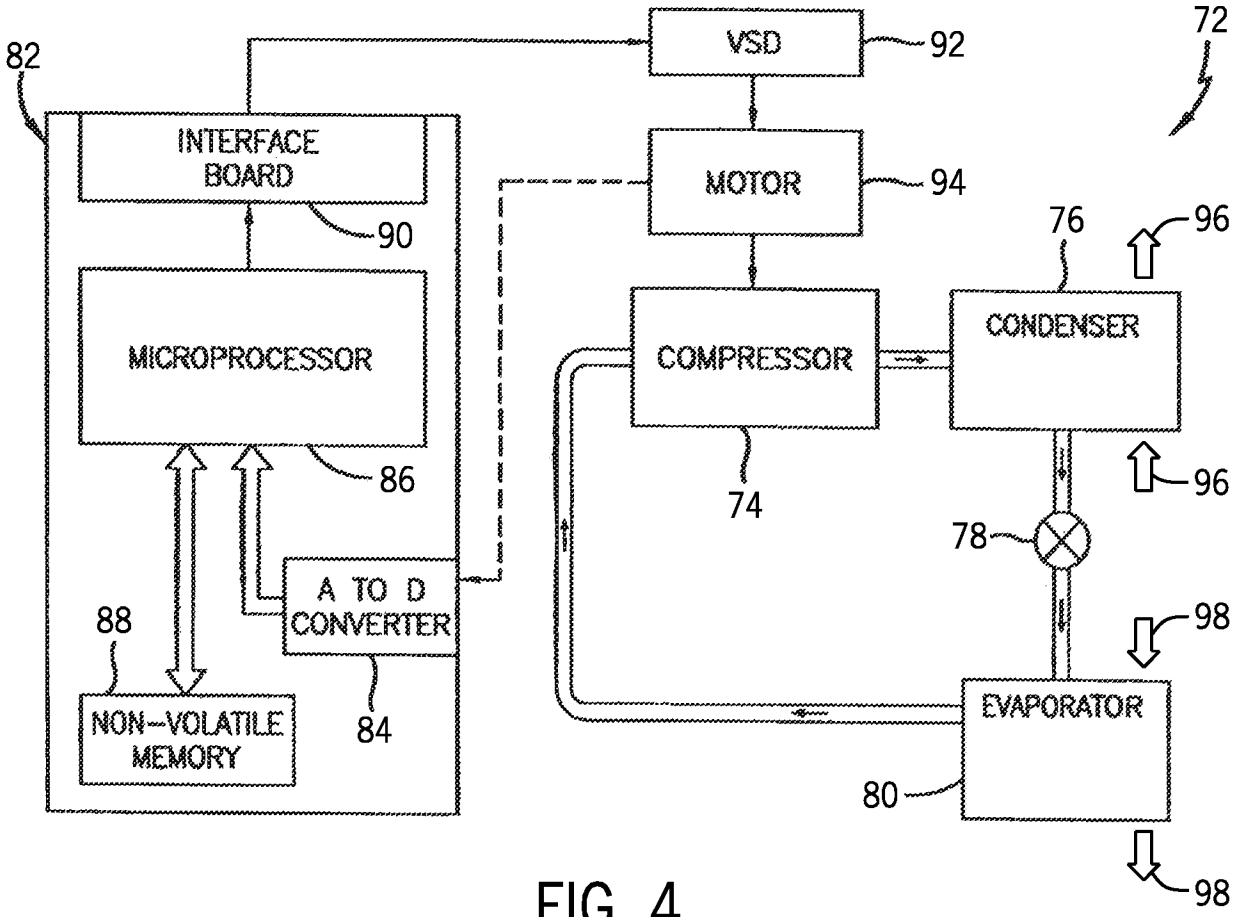
FIG. 4 is a schematic of an embodiment of the vapor compression system of FIG. 2, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, embodiments of the present disclosure are directed to a heat exchanger, such as a micro-channel heat exchanger that includes multiple slabs disposed adjacent to one another. Each slab may include a plurality of tubes or micro-channel tubes that extend along a length of the slab. The heat exchanger may be configured to enable the refrigerant to complete a first pass through the first slab and a second and third pass through the second slab. A heat exchange fluid, such as cooling air, may be directed across cooling fins of the first and second slabs of the heat exchanger. As such, the heat exchange fluid may remove thermal energy from the refrigerant during each pass.

Figure 5:
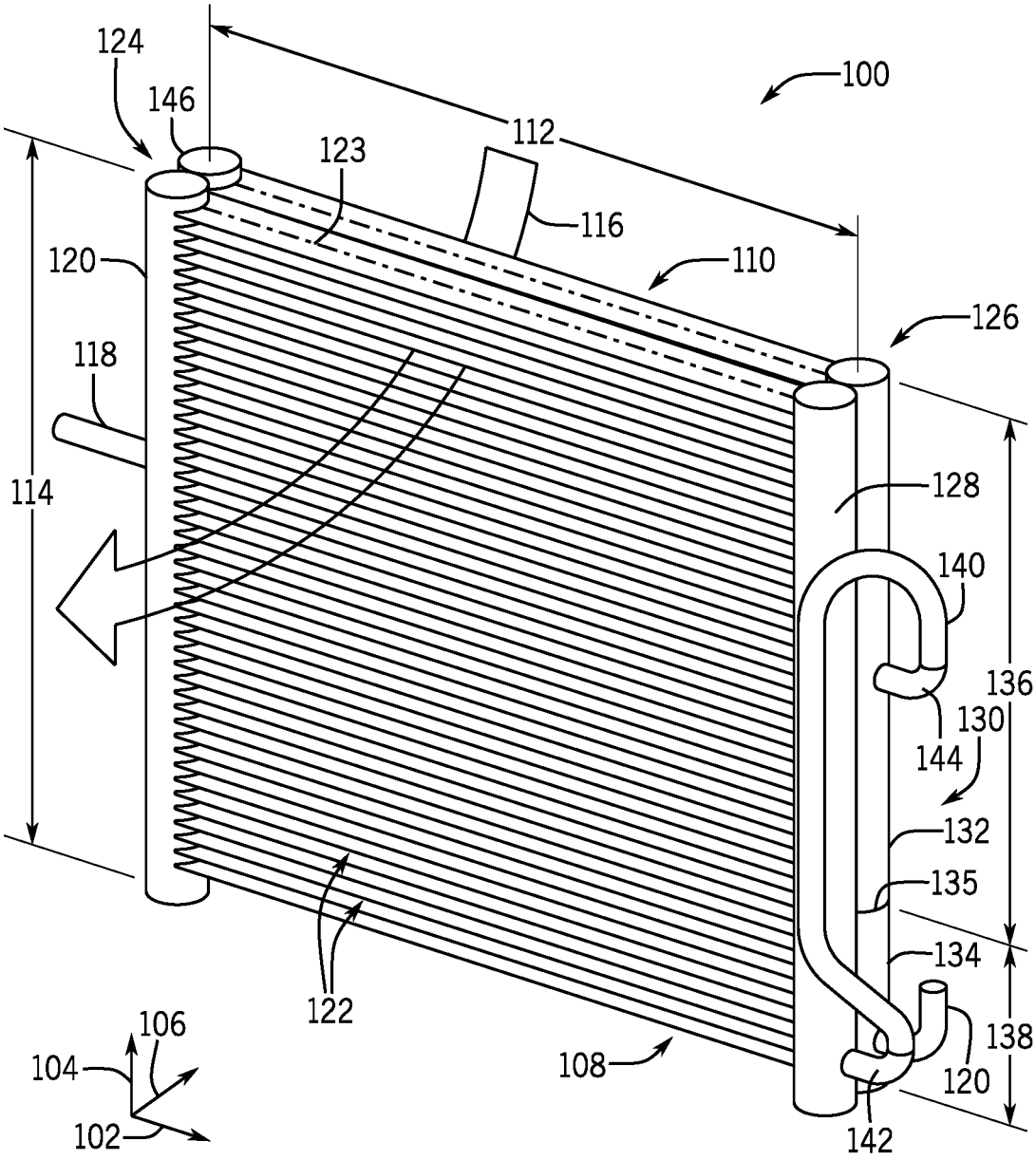
FIG. 5 is a perspective view of an embodiment of a heat exchanger that may be used in the vapor compression system of FIGS. 2 and 3, in accordance with an aspect of the present disclosure.

With the foregoing in mind, FIG. 5 illustrates a perspective view of an embodiment of a multi-pass heat exchanger 100 that may be used in the embodiments of the HVAC unit 12 shown in FIG. 1, the residential heating and cooling system 50 shown in FIG. 3, or any suitable HVAC system. To facilitate discussion, the multi-pass heat exchanger 100 and its components may be described with reference to a longitudinal axis or direction 102, a vertical axis or direction 104, and a lateral axis or direction 106. The multi-pass heat exchanger 100 includes a first slab 108 or first heat exchanger and a second slab 110 or second heat exchanger that are disposed adjacent and parallel to one another along the longitudinal direction 102. For example, a width of the first slab 108 may be disposed adjacent and parallel to a width of the second slab 110. The first slab 108 and the second slab 110 may be coupled together via fasteners, such as bolts or clamps, adhesives, such as bonding glue, welding, or any suitable method known in the art. While the first and second slab 108 and 110 may be integrally formed or joined with one another, one of ordinary skill in the art would appreciate that such a configuration would include two slabs.

The first slab 108 and the second slab 110 may each have a length 112 and a height 114 that extends along the longitudinal direction 102 and the vertical direction 104, respectively. A heat exchange fluid 116, such as air, may flow transversely along the lateral direction 106 across the first and second slabs 108, 110. As described in greater detail herein, the heat exchange fluid 116 may be used to transfer thermal energy between the refrigerant flowing through the multi-pass heat exchanger 100 and an ambient environment.

The multi-pass heat exchanger 100 may be fluidly coupled to the conduits of the vapor compression system 72 at a main inlet 118 and a main outlet 120. The refrigerant from the vapor compression system 72 may flow through the main inlet 118 and enter a distribution manifold 120 of the first slab 108. The distribution manifold 120 may distribute the refrigerant to a first plurality of tubes 122 or a first network of heat exchanger tubes, such as micro-channel tubes, that extend along the length 112 of the first slab 108. The distribution manifold 120 may extend across the full height 114 of the first slab 108, such that the refrigerant is directed to each tube 123 of the first plurality of tubes 122. The distribution manifold 120 also extends along a width that is generally parallel to the lateral direction 106. In certain embodiments, the width of the distribution manifold 120 is indicative of the width of the first plurality of tubes 122. The refrigerant may flow through the first plurality of tubes 122 from a first end portion 124 to a second end portion 126 of the multi-pass heat exchanger 100, and thus complete a first pass through the multi-pass heat exchanger 100. The refrigerant is collected in a collection manifold 128 of the first slab 108 before being directed into the second slab 110.

In some embodiments, the second slab 110 may include a split manifold 130 that extends along the height 114 of the second slab 110. The split manifold 130 may be divided into an upper distribution manifold 132, or an upper chamber, and a lower collection manifold 134, or a lower chamber, via a cap plate 135. The cap plate 135 may be coupled to an interior region of the split manifold 130 via an adhesive, welding, or other manner, and thus divide the split manifold 130 into the upper distribution manifold 132 and the lower collection manifold 134. In some embodiments, the upper distribution manifold 132 and the lower collection manifold 134 may be separate manifolds that each extend along the vertical direction 104, such that the upper distribution manifold 132 and the lower collection manifold 134 may be axially coupled to one another with respect to the vertical direction 104 via the adhesive and/or fasteners. The upper distribution manifold 132 may extend along a first length 136 or a first portion of the height 114, and the lower collection manifold 134 may extend along a second length 138 or a second portion of the height 114. The upper distribution manifold 132 and the lower collection manifold 134 each also extend along a respective width that is generally parallel to the lateral direction 106. As described in greater detail herein, the split manifold 130 enables the refrigerant to complete two passes through the second slab 110 of the multi-pass heat exchanger 100. A manifold tube 140 may fluidly couple an outlet 142 of the collection manifold 128 to an inlet 144 of the upper distribution manifold 132. The manifold tube 140 may be coupled to the outlet 142 and the inlet 144 via brazing, welding, or any other suitable method.

Figure 7:
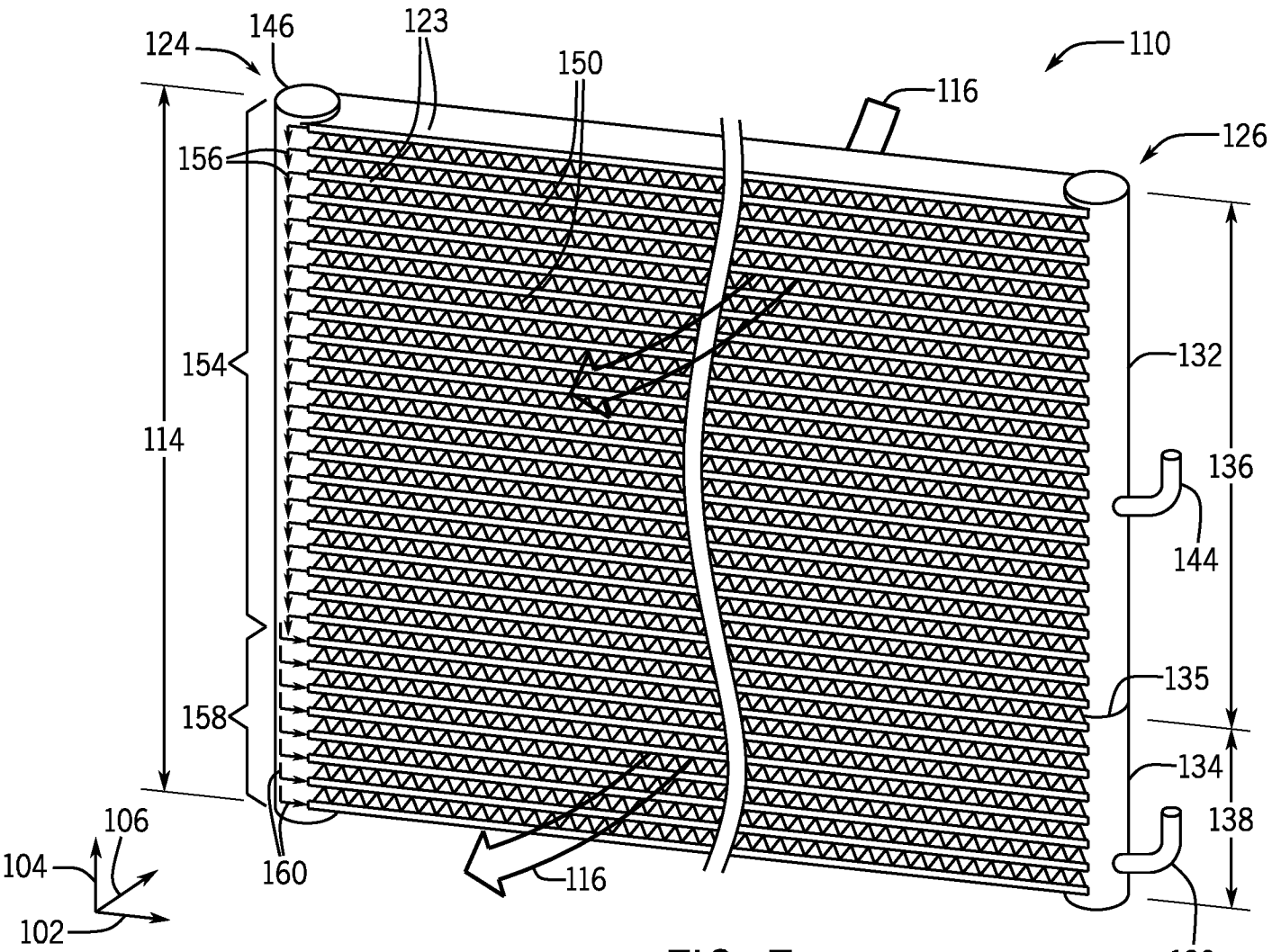
FIG. 7 is a perspective view of an embodiment of a second slab of the heat exchanger of FIG. 5, in accordance with an aspect of the present disclosure.

The upper distribution manifold 132 may be in fluid communication with a second plurality of tubes, as shown in FIG. 7, that extend from the second end portion 126 to the first end portion 124 of the multi-pass heat exchanger 100. The refrigerant may flow through the second plurality of tubes from the upper distribution manifold 132 toward a collection manifold 146 of the second slab 110. The collection manifold 146 may extend across the full height 114 of the second slab 110, and direct the refrigerant into a third plurality of tubes, as shown in FIG. 7, that are in fluid communication with the lower collection manifold 134. The refrigerant may flow from the collection manifold 146 near the first end portion 124 of the multi-pass heat exchanger 100 to the lower collection manifold 134 near the second end portion 126 of the multi-pass heat exchanger 100, and thus complete a third pass. The refrigerant may exit the multi-pass heat exchanger 100 and return to the vapor compression system 72 via the main outlet 120.

Figure 6:
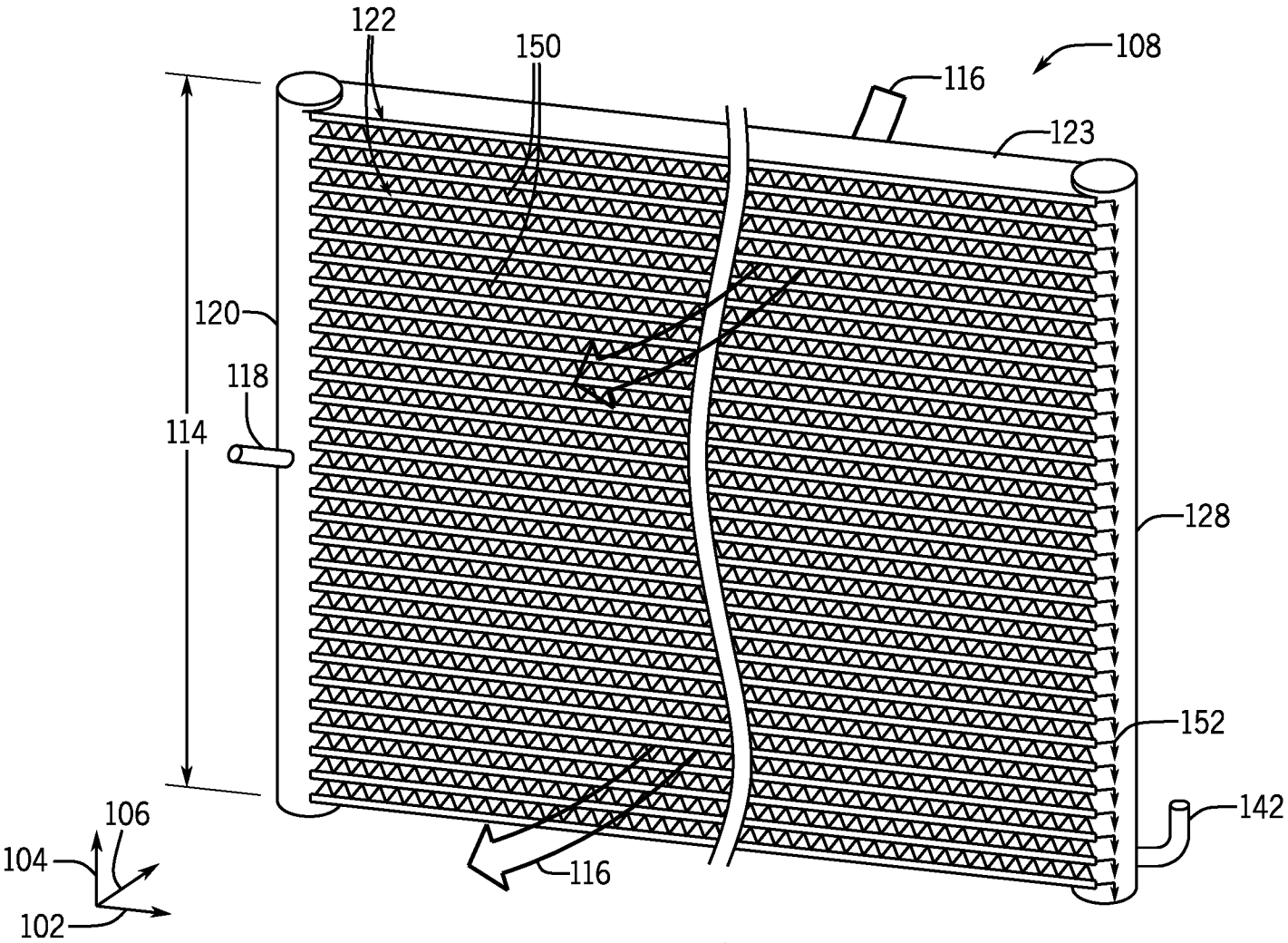
FIG. 6 is a perspective view of an embodiment of a first slab of the heat exchanger of FIG. 5, in accordance with an aspect of the present disclosure.

FIG. 6 is a perspective view of the first slab 108 of the multi-pass heat exchanger 100. As discussed above, the refrigerant may be distributed across the full height 114 of the first slab 108 via the distribution manifold 120. In some embodiments, the refrigerant flowing into the distribution manifold 120 from the main inlet 118 may be in the gaseous phase. The gaseous refrigerant may be directed through the first plurality of tubes 122 along the longitudinal direction 102 to complete the first pass. As such, the gaseous refrigerant may transfer thermal energy to the first plurality of tubes 122 and cooling fins 150 disposed between each tube 123 of the first plurality of tubes 122. The heat exchange fluid 116, such as cooling air, may flow transversely along the lateral direction 106 across the first slab 108 and between the cooling fins 150. The cooling fins 150 increase a heat transfer surface area of the first plurality of tubes 122, which may enable the gaseous refrigerant within the first plurality of tubes 122 to exchange thermal energy with the heat exchange fluid 116 more effectively.

In some embodiments, the gaseous refrigerant may change phase while flowing through the first pass of the multi-pass heat exchanger 100. For example, a portion of the gaseous refrigerant may condense such that a mixture of gaseous refrigerant and liquid refrigerant may exit the first plurality of tubes 122. In other embodiments, substantially all of the gaseous refrigerant may condense, such that the refrigerant may exit the first plurality of tubes 122 in a substantially liquid phase. The collection manifold 128 may collect the refrigerant exiting the first plurality of tubes 122, indicated by arrows 152, and direct the liquid refrigerant towards the outlet 142 of the collection manifold 142. The refrigerant may subsequently flow into the second slab 110 through the manifold tube 140.

FIG. 7 is a perspective view of the second slab 110 of the multi-pass heat exchanger 100. As discussed above, refrigerant may enter the upper distribution manifold 132 of the second slab 110 via the inlet 144. The upper distribution manifold 132 may distribute the refrigerant to a second plurality of tubes 154, such as a second network of heat exchanger tubes, which is in fluid communication with the upper distribution manifold 132. Accordingly, a height of the second plurality of tubes 154 is indicative of the first length 136 or a height of the upper distribution manifold 132. As discussed above, the upper distribution manifold 132 also includes a width extending along the lateral direction 106, such that the width of the upper distribution manifold 132 may be indicative of a width of the second plurality of tubes 154. The refrigerant may complete the second pass by flowing through the second plurality of tubes 154 by from the second end portion 126 of the multi-pass heat exchanger 100 to the first end portion 124 of the multi-pass heat exchanger 100. While completing the second pass, the refrigerant may exchange thermal energy with the heat exchange fluid 116 flowing across the fins 150 of the second plurality of tubes, before flowing into the collection manifold 146 of the second slab 110, as indicated by arrows 156. As such, the refrigerant within the collection manifold 146 may be of a lower thermal energy than the refrigerant within the upper distribution manifold 132. For example, the refrigerant may enter the first plurality of tubes 154 as a two-phase mixture and condense while flowing through the second pass, such that the refrigerant may exit the second plurality of tubes 154 in a substantially liquid phase. In some embodiments, the refrigerant may already enter the first plurality of tubes 154 in the liquid phase, such that the second pass may sub-cool the liquid refrigerant.

The collection manifold 146 may be in fluid communication with a third plurality of tubes 158, or a third network of heat exchanger tubes, which extend between the collection manifold 146 and the lower collection manifold 134. Accordingly, a height of the third plurality of tubes 158 is indicative of the third length 138 or a height of the lower collection manifold 134. In certain embodiments, the width of the lower collection manifold 134 is indicative of a width of the third plurality of tubes 158. The collection manifold 146 may distribute the refrigerant exiting the second plurality of tubes 154 to the third plurality of tubes 158, as indicated by arrows 160. The refrigerant may thus flow through the third plurality of tubes 158 from the first end portion 124 of the multi-pass heat exchanger 100 to the second end portion 126 of the multi-pass heat exchanger 100 to complete the third pass. The refrigerant may transfer thermal energy to the heat exchange fluid 116 via the fins 150 when completing the third pass. As such, the third plurality of tubes 158 may sub-cool the refrigerant. The refrigerant may exit the lower collection manifold 134 through the main outlet 120, and be directed through the vapor compression system 72. It should be noted that in certain embodiments, the collection manifold 146 may include a pair of separate manifolds that are associated with the second plurality of tubes 154 and the third plurality of tubes 158, respectively. For example, a first manifold of the pair of manifolds may couple to the second plurality of tubes 154, while a second manifold of the pair of manifolds may couple to the third plurality of tubes 158. In such embodiments, the first and second manifolds are placed in fluid communication with one another, such that refrigerant may flow from the second plurality of tubes 154 to the third plurality of tubes 158 by flowing through the first manifold and the second manifold.

The first length 136 of the upper distribution manifold 132 and the second length 138 of the lower collection manifold 134 adjusts a proportion of tubes 123 within the second pass and the third pass of the multi-pass heat exchanger 100, respectively. For example, increasing the first length 136 and decreasing the second length 138 while the height 114 remains substantially constant may increase a quantity of tubes 123 in the second pass and decrease a quantity of tubes 123 in the third. A ratio between the quantity of tubes 123 in the second pass and the quantity of tubes 123 in the third pass may be optimized to increase the efficiency of the multi-pass heat exchanger.

For example, experimental tests may be used to determine which ratio of tubes between the first pass and the second pass results in the largest temperature drop or the most efficient rate of heat transfer between refrigerant entering the second slab 110 through the inlet 144 and refrigerant exiting the second slab 110 through the main outlet 120. The experimental test may include the collection of empirical data, such as temperature measurements of the refrigerant taken near the inlet 144 and the main outlet 120, to determine the optimal ratio of tubes 123 between the second pass and the third pass. As a non-limiting example, it may be determined that an optimal heat transfer efficiency of the second slab 110 is achieved when the second plurality of tubes 154 includes seventy percent of the tubes 123 within the second slab 110 and the third plurality of tubes 158 includes the remaining thirty percent of the tubes 123 within the second slab 110. In other embodiments, the second plurality of tubes 154 may include more than fifty percent of the tubes 123 within the second slab 110, more than sixty percent of the tubes 123 within the second slab 110, or any other suitable percentage of the tubes 123 within the second slab 110, while the third plurality of tubes 158 includes the respective remaining portion of the tubes 123.

In some embodiments, a radial dimension of the first plurality of tubes 122, the second plurality of tubes 154, and/or the third plurality of tubes 158 may each be the same or different. For example, each tube 123 of the first plurality of tubes 122 may have a radial dimension of twenty five millimeters, while each tube 123 of the second plurality of tubes 154 and the third plurality of tubes 158 may have a radial dimension of eighteen millimeters. In some embodiments, all tubes of the first plurality of tubes 122, the second plurality of tubes 154, and the third plurality of tubes 158 may have radial dimension that is substantially similar. For example, in one embodiment, the first plurality of tubes 122, the second plurality of tubes 154, and the third plurality of tubes 158 may each have an inside diametral that is less than one millimeter (mm). In some embodiments, the radial dimensions of the tubes 123 may be used to optimize the heat transfer efficiency of the multi-pass heat exchanger 100, using experimental trials similar to those described above. For example, it may be determined that gaseous refrigerant flowing through the first plurality of tubes 122 flows more effectively in a larger diameter tube 123, while liquid refrigerant flowing through the second plurality of tubes 154 and/or the third plurality of tubes 156 flows more effectively in a smaller diameter tube 123. It should be noted that the tubes 123 within the first plurality of tubes 122, the second plurality of tubes 154, the third plurality of tubes 158 are not limited to an oval or a circular cross section, but can be square, triangular, or any other suitable cross-sectional shape.

Figure 8:
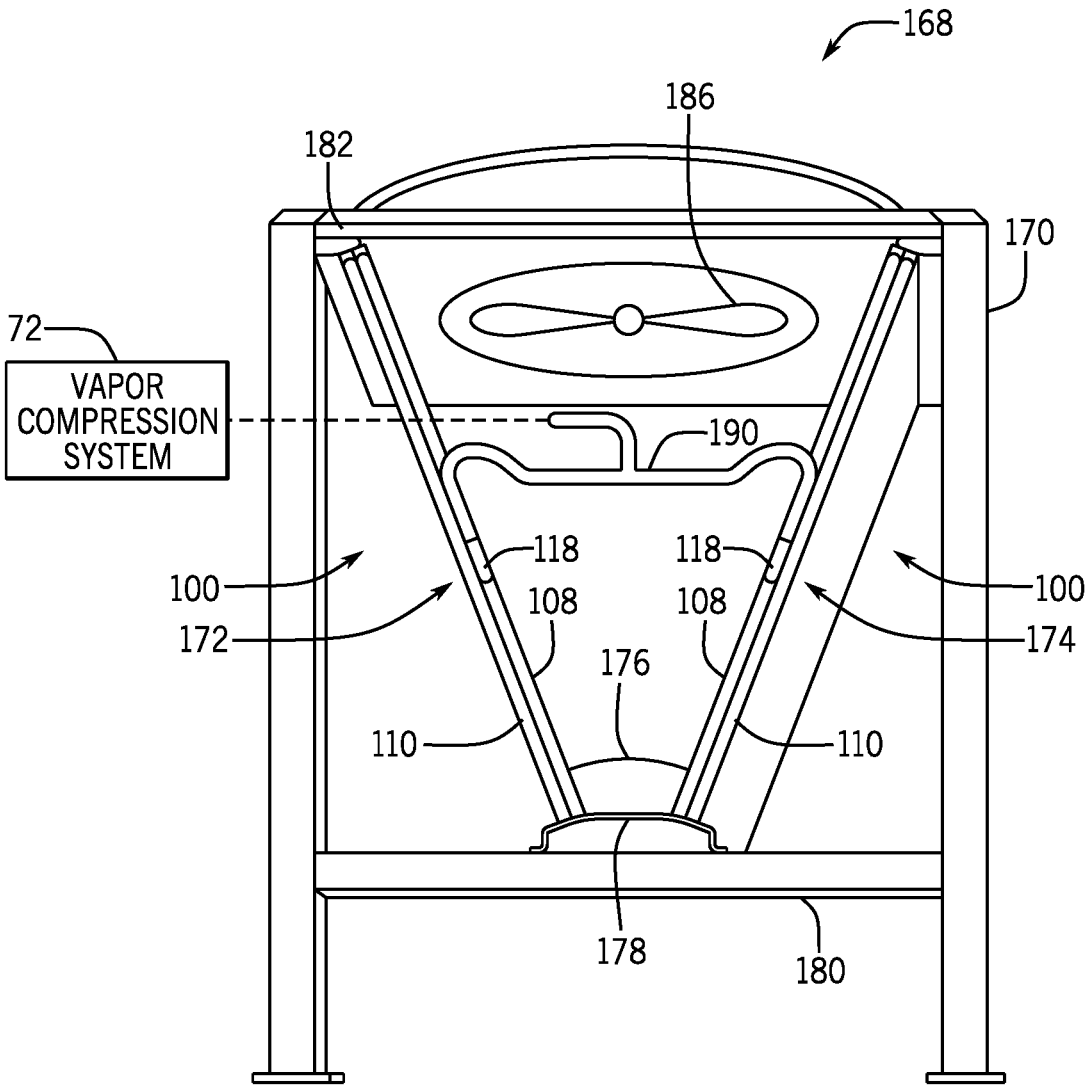
FIG. 8 is a front view of an embodiment of a heat exchanger system including the heat exchanger of FIG. 5, in accordance with an aspect of the present disclosure.

FIG. 8 illustrates a front view an embodiment of a heat exchanger system 168. The heat exchanger system 168 may be used to couple two multi-pass heat exchangers 100 together in a parallel flow path. For example, a frame 170 may be used to support a first multi-pass heat exchanger 172 and a second multi-pass heat exchanger 174. The first and second multi-pass heat exchangers 172, 174 may be positioned at an angle 176 relative to one another. In some embodiments, the angle 176 may be between zero and ninety degrees, such that the first and second multi-pass heat exchangers 172, 174 are positioned in a "V-shape" configuration. A mounting bracket 178 may be used to couple a lower portion the first and second multi-pass heat exchangers 172, 174 to a cross-member 180 of the frame 170. An upper portion of the first and second multi-pass heat exchangers 172, 174 may couple to a shroud 182 of the frame 170. As discussed in greater detail herein, the shroud 182 may include a fan 186, such as the fan 32, which is configured to direct a cooling fluid across the first and second slabs 108, 110 of each multi-pass heat exchanger 100.

An inlet manifold 190 may receive a flow of refrigerant from the vapor compression system 72 and direct the refrigerant toward the multi-pass heat exchangers 100. The inlet manifold 190 may split the flow of refrigerant into two separate flows, such that a first flow of refrigerant may enter the main inlet 118 of the first multi-pass heat exchanger 172 and a second flow of refrigerant may enter the main inlet 118 of the second multi-pass heat exchanger 174. The first and second flows of refrigerant may each complete a first pass through the first plurality of tubes 122 within first slab 108 of the first multi-pass heat exchanger 174 or the second multi-pass heat exchanger 176, respectively.

Figure 9:
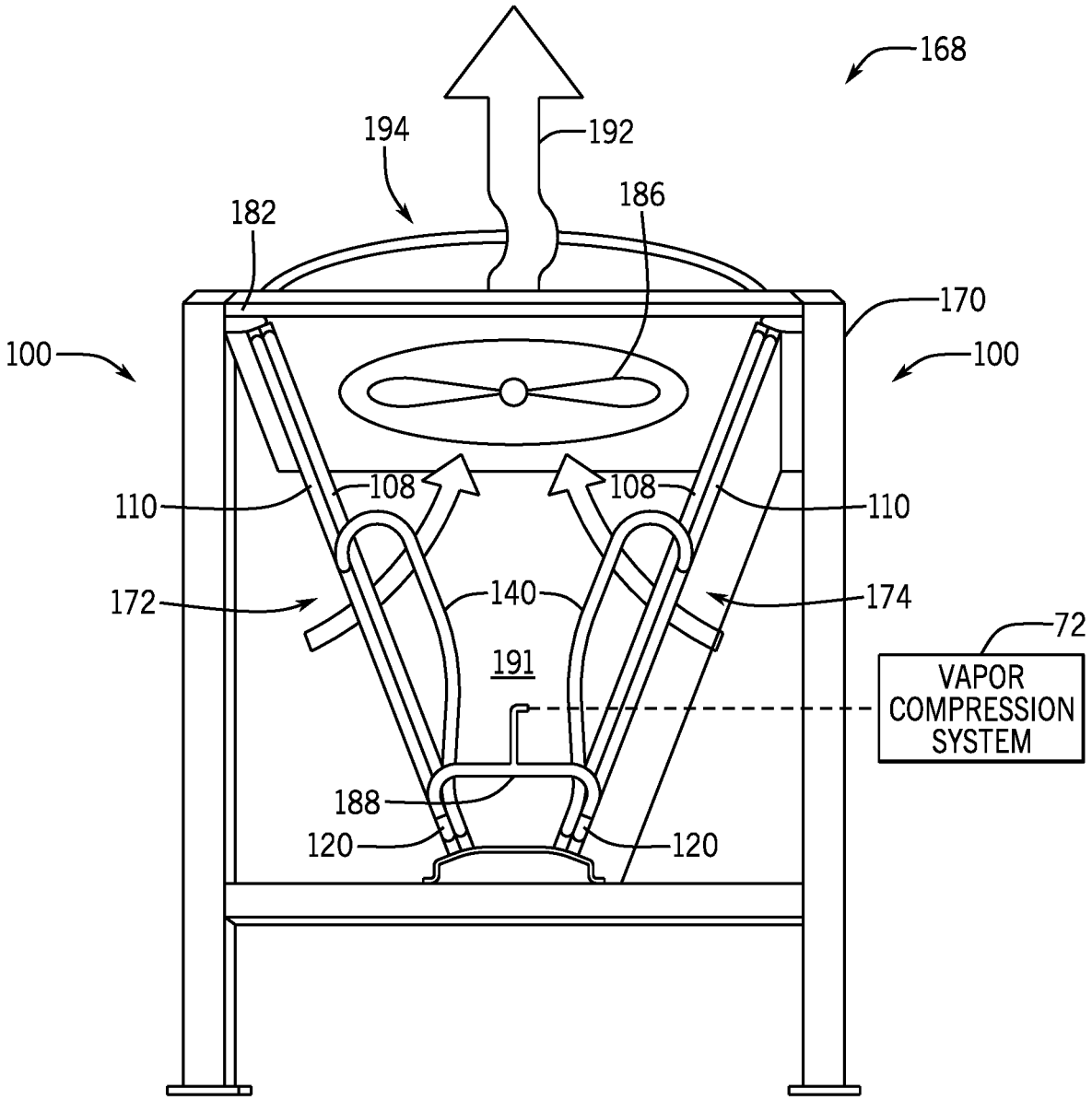
FIG. 9 is a rear view of an embodiment of the heat exchanger system of FIG. 8, in accordance with an aspect of the present disclosure.

With the foregoing in mind, FIG. 9 illustrates a rear view of an embodiment of the heat exchanger system 168. When each of the first and second flows of refrigerant complete the first pass through the respective first slabs 108, the first and second flows of refrigerant are directed to respective second slabs 110 via the manifold tubes 140, and complete respective second and the third passes through the multi-pass heat exchangers 100. The first and second flow of refrigerant may exit the main outlet 120 of the first multi-pass heat exchanger 172 and the second multi-pass heat exchanger 174, respectively, and combine into a single refrigerant flow via a return manifold 188. In some embodiments, the refrigerant may be redirected back toward the vapor compression system 72.

Figure 10:
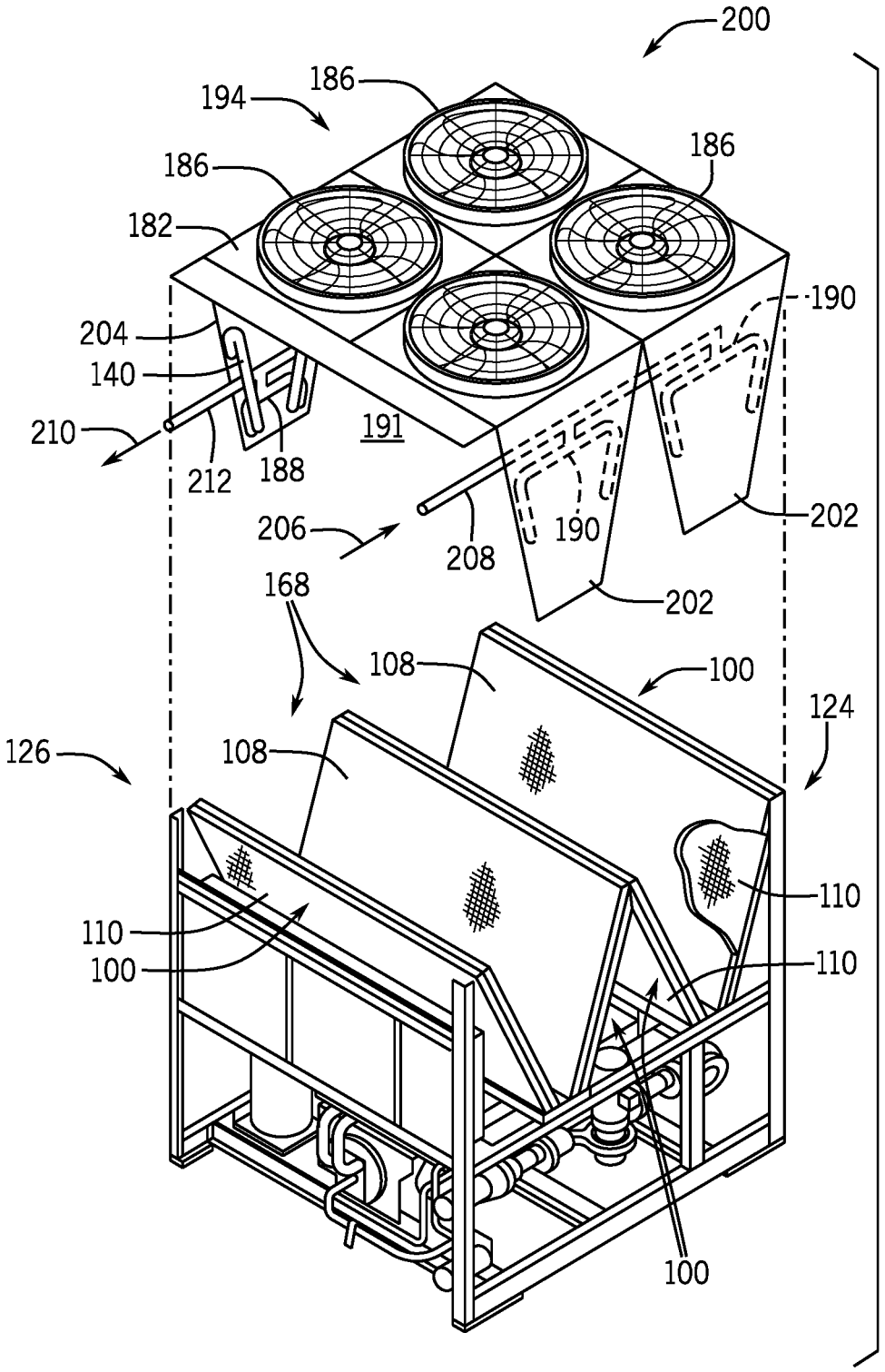
FIG. 10 is a perspective view of an embodiment of a heat exchanger unit that may be used with the vapor compression system of FIG. 2, in accordance with an aspect of the present disclosure.

As discussed above, the fan 186 may direct cooling fluid across the first and second slabs 108, 110 of each multi-pass heat exchanger 100. The heat exchanger system 168 may include forward and rear shrouds, as shown in FIG. 10, which may block heat exchange fluid 116 from bypassing the multi-pass heat exchangers 100 and entering the fan 186 directly. As such, a pressure drop between the ambient environment and an interior region 191 between the first multi-pass heat exchanger 172 and the second multi-pass heat exchanger 174 may be generated. The heat exchange fluid 116 may thus be directed through the multi-pass heat exchangers 100 and across the cooling fins 150, such that the heat exchange fluid may absorb thermal energy from the second slab 110, and subsequently absorb thermal energy from the first slab 108. After flowing through the multi-pass heat exchangers 100, the heat exchange fluid 116 may be exhausted as heated waste fluid 192 near an upper and portion 194 of the frame 170.

In some embodiments, the efficiency of each multi-pass heat exchanger 100 may be optimized by directing the heat exchange fluid 116 through the second slab 110 and before directing the heat exchange fluid 116 through the first slab 108. For example, refrigerant into the first slab 108 from the vapor compression system 72 may in a hot, gaseous state, which is of high thermal energy. As discussed above, thermal energy may be extracted from the refrigerant during the first pass through the first slab 108, such that the refrigerant exits the first slab 108 in a two-phase mixture or a completely liquid phase. The cooled, two-phase or liquid refrigerant subsequently enters the second and third passes within the second slab 110, which enables the multi-pass heat exchanger 100 to extract additional thermal energy from the refrigerant.

Because the refrigerant within the second slab 110 is of lower thermal energy than the refrigerant within the first slab 108, it is desirable to direct the heat exchange fluid 116 across the second slab 110 before directing the heat exchange fluid 116 across the first slab 108. For example, the heat exchange fluid 116 may increase in temperature due to thermal energy absorbed from the refrigerant after flowing through the second slab 110 and the first slab 108. Therefore, directing the refrigerant through the second slab 110 before directing the refrigerant through the first slab 108 may enable the second slab 110 to contact fresh, unheated heat exchange fluid 116 flowing directly from the ambient environment. The heat exchange fluid 116 may absorb thermal energy from the pre-cooled refrigerant within the second slab 110 that has already been cooled while completing the first pass within the first slab 108. The heat exchange fluid 116 may thus increase in temperature when absorbing thermal energy from the refrigerant within the second slab 110, however, the thermal exchange fluid 116 may still be cooler than the refrigerant within the first slab 108. The warmed heat exchange fluid 116 exiting the second slab 110 may thus absorb additional thermal energy from the refrigerant within the first slab 108. The heat exchange fluid 116 may exit the first slab 108 as the heated waste fluid 190 that is directed to the ambient environment via the fan 186.

FIG. 10 illustrates an embodiment of a heat exchanger unit 200 that includes multiple exchanger systems 168. While two heat exchanger systems 168 are shown in the illustrated embodiment of the heat exchanger unit 200, the heat exchanger unit may include 1, 3, 4, 5, 6, 7, 8 or more heat exchanger system 168. As discuses above, a forward shroud 202 and a rear shroud 204 may be used to enclose an opening near the first end portion 124 and the second end portion 126, respectively, of each of the multi-pass heat exchangers 100. In some embodiments, hot, gaseous refrigerant may be directed from the vapor compression system 72 toward the heat exchanger unit 200, as indicated by arrow 206, via an inlet conduit 208 that may couple to the inlet manifold 190 of each heat exchanger system 168. The gaseous refrigerant may be cooled and condensed by flowing through a respective multi-pass heat exchanger 100 of the heat exchanger unit 200 and return the vapor compression system 72, as indicated by arrow 210, via an outlet conduit 212 that may couple to the return manifolds 188 of each heat exchanger system 168.

Figure 11:
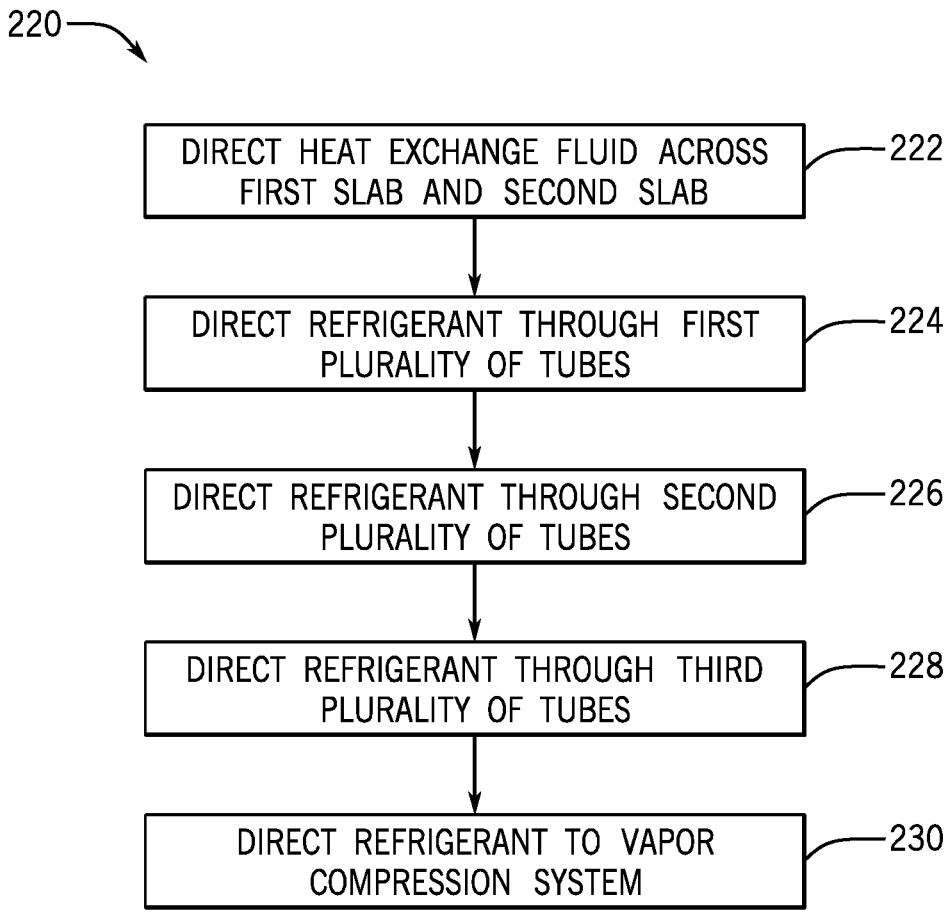
FIG. 11 is an embodiment of a method that may be used to operate the heat exchanger of FIG. 5, in accordance with an embodiment in the present disclosure.

FIG. 11 is an embodiment of a method 220 that may be used to operate the multi-pass heat exchanger 100. The heat exchange fluid 116 may be directed, as indicated by process block 222, across the first slab 108 and the second slab 110 of the multi-pass heat exchanger 100 using a fan 186. For example, the heat exchange fluid 116 may be configured to flow across the cooling fins 150 of the first slab 108 and the cooling fins 150 of the second slab 110. In some embodiments, the heat exchange fluid 116 may be configured to flow across the cooling fins 150 of the second slab 110 prior to flowing across the cooling fins 150 of the first slab 108. As discussed above, directing the cooling fluid 116 across the second slab 110 prior to the first slab 108 may enable the cooling fluid to absorb thermal energy from the substantially cool refrigerant within the second slab 110 before absorbing thermal energy from the substantially hot refrigerant within the first slab 108.

In some embodiments, gaseous refrigerant from the vapor compression system 72 may be directed, as indicated by process block 224, through the first plurality of tubes 122 of the first slab 108 and condense into a two-phase mixture of liquid refrigerant and gaseous refrigerant. For example, the cooling fluid 116 flowing across the first slab 108 may absorb thermal energy from the gaseous refrigerant, such that the gaseous refrigerant may condense into the two-phase state. In some embodiments, the gaseous refrigerant may condense into a substantially liquid state after completing the first pass. The two-phase or liquid refrigerant may be directed, as indicated by process block 226, through the second plurality of tubes 154 of the second slab 110, such that the cooling fluid 116 may absorb additional thermal energy from the two-phase and/or liquid refrigerant. If the refrigerant enters the second slab 110 in the substantially liquid state, the refrigerant may be sub-cooled while completing the second pass. The liquid refrigerant may be directed, as indicated by process block 228, through the third plurality of tubes 158, such that the liquid refrigerant may be sub-cooled while additional thermal energy is removed from the refrigerant. The sub-cooled refrigerant may be directed, as indicated by process block 230, toward the vapor compression system 72 for reuse in the vapor compression system 72.

The aforementioned embodiments of the multi-pass heat exchanger 100 may be used on the HVAC unit 12, the residential heating and cooling system 50, or in any suitable vapor compression system. Additionally, the specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A heat exchanger for a heating, ventilating, and air conditioning (HVAC) system, comprising:

a first slab, wherein the first slab comprises a first plurality of tubes extending along a length of the heat exchanger between a first manifold and a second manifold, wherein the first plurality of tubes is stacked along a height of the heat exchanger between a first edge of the heat exchanger and a second edge of the heat exchanger; and a second slab, wherein the second slab comprises a second plurality of tubes and a third plurality of tubes, wherein the second plurality of tubes extends between a third manifold and a fourth manifold and the third plurality of tubes extends between the fourth manifold and a fifth manifold, wherein the heat exchanger defines a refrigerant path sequentially through the first plurality of tubes, the second plurality of tubes, and the third plurality of tubes, wherein the second manifold comprises an outlet positioned adjacent the first edge of the heat exchanger and configured to receive a refrigerant flow from the first plurality of tubes, and wherein the third manifold is positioned adjacent the second edge of the heat exchanger and configured to receive the refrigerant flow from the outlet.

2. The heat exchanger of claim 1, wherein the heat exchanger is a micro-channel heat exchanger, and wherein each tube of the first plurality of tubes, each tube of the second plurality of tubes, and each tube of the third plurality of tubes comprises multiple channels.

3. The heat exchanger of claim 1, wherein the third manifold and the fifth manifold are axially coupled to one another.

4. The heat exchanger of claim 3, wherein the third manifold extends along a first portion of a height of the second slab, and the fifth manifold extends along a second portion of the height of the second slab, wherein the height of the second slab is equal to the height of the heat exchanger.

5. The heat exchanger of claim 4, wherein the first portion comprises approximately seventy percent of the height of the second slab and the second portion comprises approximately thirty percent of the height of the second slab.

6. The heat exchanger of claim 1, wherein each tube of the first plurality of tubes comprises a first radial dimension, each tube of the second plurality of tubes comprises a second radial dimension, and each tube of the third plurality of tubes comprises a third radial dimension, wherein the first radial dimension is different from the second radial dimension and the third radial dimension.

7. The heat exchanger of claim 1, comprising a fan configured to draw air across the second slab and the first slab sequentially.

8. A heating, ventilating, and air conditioning (HVAC) heat exchanger, comprising:

a first slab extending along a length of the HVAC heat exchanger and between an upper edge of the HVAC heat exchanger and a lower edge of the HVAC heat exchanger, wherein the first slab comprises a first manifold and a second manifold and a first plurality of tubes extending between the first manifold and the second manifold to define a first pass of the HVAC heat exchanger, wherein the second manifold comprises an upper subsection extending from the upper edge and along a first portion of a height of the HVAC heat exchanger and a lower subsection extending from the lower edge and along a second portion of the height of the HVAC heat exchanger;

a second slab extending along the length of the HVAC heat exchanger, wherein the second slab comprises a third manifold and a fourth manifold, wherein the third manifold is divided into an upper chamber and a lower chamber, wherein the upper chamber extends from the upper edge and along the first portion of the height of the HVAC heat exchanger and the lower chamber extends from the lower edge and along the second portion of the height of the HVAC heat exchanger, wherein a second plurality of tubes extends between the upper chamber and the fourth manifold to define a second pass of the HVAC heat exchanger, and a third plurality of tubes extends between the lower chamber and the fourth manifold to define a third pass of the HVAC heat exchanger, wherein the second manifold comprises an outlet formed within the lower subsection of the second manifold, and wherein the outlet is configured to receive a refrigerant flow from the first plurality of tubes and direct the refrigerant flow toward and into the upper chamber of the third manifold.

9. The HVAC heat exchanger of claim 8, wherein the first slab and the second slab are positioned adjacent to one another and are coupled to one another.

10. The HVAC heat exchanger of claim 8, wherein the third manifold is divided into the upper chamber and the lower chamber via a cap plate disposed within the third manifold, wherein the cap plate forms a seal between the upper chamber of the third manifold and the lower chamber of the third manifold.

11. The HVAC heat exchanger of claim 8, wherein the first portion comprises approximately seventy percent of the height and the second portion comprises approximately thirty percent of the height.

12. The HVAC heat exchanger of claim 8, comprising:

a third slab extending along the length of the HVAC heat exchanger, wherein the third slab comprises a fifth manifold and a sixth manifold and a fourth plurality of tubes extending between the fifth manifold and the sixth manifold;

a fourth slab extending along the length of the HVAC heat exchanger, wherein the fourth slab comprises a seventh manifold and an eighth manifold, wherein the seventh manifold is divided into an additional upper chamber and an additional lower chamber, wherein a fifth plurality of tubes extends between the additional upper chamber and the eighth manifold, and a sixth plurality of tubes extends between the additional lower chamber and the eighth manifold.

13. The HVAC heat exchanger of claim 12, wherein the first slab and the second slab are positioned adjacent to one another to form a first heat exchanger section, the third slab and the fourth slab are positioned adjacent to one another to form a second heat exchanger section, and the first and second heat exchanger sections are arranged in a V-shaped configuration.

14. The HVAC heat exchanger of claim 8, comprising a connection tube extending between the lower subsection of the second manifold and the upper chamber of the third manifold.

15. The HVAC heat exchanger of claim 8, comprising a fan configured to draw air across the second slab and the first slab sequentially.

16. The HVAC heat exchanger of claim 8, wherein the third plurality of tubes comprises a sub-cooling portion of the HVAC heat exchanger.

* * * * *